US011102851B2

(12) United States Patent
Li et al.

(10) Patent No.: US 11,102,851 B2
(45) Date of Patent: Aug. 24, 2021

(54) METHOD FOR VOICE CONTROL ON MICROWAVE OVEN, AND MICROWAVE OVEN

(71) Applicant: MIDEA GROUP CO., LTD., Foshan (CN)

(72) Inventors: Nanjun Li, Foshan (CN); Junyang Zhou, Foshan (CN); Jianming Wu, Foshan (CN); Haishi Lin, Foshan (CN)

(73) Assignee: MIDEA GROUP CO., LTD., Foshan (CN)

( * ) Notice: Subject to any disclaimer, the term of this patent is extended or adjusted under 35 U.S.C. 154(b) by 366 days.

(21) Appl. No.: 16/110,876

(22) Filed: Aug. 23, 2018

(65) Prior Publication Data

US 2019/0021144 A1 Jan. 17, 2019

Related U.S. Application Data

(63) Continuation of application No. PCT/CN2016/084342, filed on Jun. 1, 2016.

(30) Foreign Application Priority Data

Feb. 23, 2016 (CN) ..... 201610098896.0

(51) Int. Cl.
*H05B 6/64* (2006.01)
*F24C 7/02* (2006.01)
(Continued)

(52) U.S. Cl.
CPC ..... *H05B 6/6435* (2013.01); *F24C 7/02* (2013.01); *F24C 7/08* (2013.01); *H05B 6/687* (2013.01)

(58) Field of Classification Search
CPC . F24C 7/02; F24C 7/08; H05B 6/6435; H05B 6/687
(Continued)

(56) References Cited

U.S. PATENT DOCUMENTS 4,340,797 A 7/1982 Takano et al.
4,350,860 A 9/1982 Ueda
(Continued)

FOREIGN PATENT DOCUMENTS

CN 2769720 Y 4/2006
CN 201051396 Y 4/2008
(Continued)

OTHER PUBLICATIONS

Midea Group Co.Lt., , Notification of Reason for Refusal KR10-20187027361, dated Nov. 22, 2019, 9 pgs.
(Continued)

*Primary Examiner* — Dana Ross
*Assistant Examiner* — Ket D Dang
(74) *Attorney, Agent, or Firm* — Morgan, Lewis & Bockius LLP

(57) ABSTRACT

A method for voice control on a microwave oven, and a microwave oven. The method for voice control on a microwave oven comprises a step of receiving a voice instruction input by a user (S10), a step of checking whether default menu parameters corresponding to the voice instruction are pre-stored (S20), a step of controlling the operation of a microwave oven according to the default menu parameters (S30), and a step of controlling, when receiving a parameter change instruction, the operation of the microwave oven according to changed parameters, and updating the default menu parameters (S40). The microwave oven comprises a receive module (10), a check module (20), a control module (30) and an update module (40). The parameters of the microwave oven can be changed to meet different requirements.

8 Claims, 6 Drawing Sheets

(51) Int. Cl.
*F24C 7/08* (2006.01)
*H05B 6/68* (2006.01)

(58) Field of Classification Search
USPC ..... 219/714, 702, 720, 685, 490, 492, 494, 219/501, 497, 506, 508, 1.55 B, 1.55 M; 99/325, 451; 700/207, 211, 17; 340/692, 340/602, 569, 540, 500, 384 E
See application file for complete search history.

(56) References Cited

U.S. PATENT DOCUMENTS

| | | | | |
|---|---|---|---|---|
| 4,506,142 | A | 3/1985 | Takano et al. | |
| 4,513,189 | A * | 4/1985 | Ueda | H05B 6/6435 219/490 |
| 6,559,882 | B1 | 5/2003 | Kerchner | |
| 2003/0141295 | A1* | 7/2003 | Ishikawa | H05B 6/688 219/697 |
| 2007/0030161 | A1 | 2/2007 | Yang | |
| 2013/0306627 | A1 | 11/2013 | Libman et al. | |
| 2015/0163865 | A1* | 6/2015 | Lee | A23L 5/10 426/231 |
| 2016/0139790 | A1* | 5/2016 | Shinomoto | G06F 3/04842 715/740 |
| 2016/0147208 | A1* | 5/2016 | Shinomoto | G05B 15/02 700/83 |
| 2016/0283822 | A1* | 9/2016 | Imai | G06K 9/6212 |
| 2016/0309548 | A1 | 10/2016 | Libman et al. | |

FOREIGN PATENT DOCUMENTS

| | | | |
|---|---|---|---|
| CN | 101334182 | A | 12/2008 |
| CN | 101387414 | A | 3/2009 |
| CN | 101411592 | A | 4/2009 |
| CN | 203131888 | U | 8/2013 |
| CN | 103791528 | A | 5/2014 |
| CN | 104106973 | A | 10/2014 |
| CN | 104251501 | A | 12/2014 |
| CN | 105223856 | A | 1/2016 |
| CN | 105570940 | A | 5/2016 |
| EP | 0025513 | A1 | 3/1981 |
| EP | 0031141 | A1 | 7/1981 |
| EP | 1028604 | A2 | 8/2000 |
| JP | 2001074248 | A | 3/2001 |
| JP | 2005140418 | A | 6/2005 |
| JP | 2007132567 | A | 5/2007 |
| JP | 2010061382 | A | 3/2010 |
| JP | 2010123101 | A | 6/2010 |
| JP | 2011257055 | A | 12/2011 |
| JP | 2014043964 | A | 3/2014 |
| JP | 2014202414 | A | 10/2014 |
| JP | 2015158351 | A | 9/2015 |
| KR | 1020030003790 | A | 1/2003 |
| WO | WO2012/109634 | A1 | 8/2012 |
| WO | WO2015059920 | A1 | 4/2015 |

OTHER PUBLICATIONS

Midea Group Co Ltd, Notice of Reasons for Refusal, JP2018-544512, dated Oct. 1, 2019, 6 pgs.
Midea Group Co. Ltd., Supplementary European Search Report, dated Feb. 26, 2019, 6 pgs.
Midea, International Search Report and Written Opinion, PCT/CN2016/084342, dated Nov. 25, 2016, 10 pgs.
Midea Group Co. Ltd., First Office Action, CN201610098896.0, dated Oct. 2018, 13 pgs.

* cited by examiner

METHOD FOR VOICE CONTROL ON MICROWAVE OVEN, AND MICROWAVE OVEN

PRIORITY CLAIM AND RELATED APPLICATION

This application is a continuation of PCT Patent Application No. PCT/CN2016/084342, entitled "METHOD FOR VOICE CONTROL ON MICROWAVE OVEN, AND MICROWAVE OVEN" filed on Jun. 1, 2016, which claims priority to Chinese Patent Application No. 201610098896.0, entitled "METHOD FOR VOICE CONTROL ON MICROWAVE OVEN, AND MICROWAVE OVEN" filed with the State Intellectual Property Office of the People's Republic of China on Feb. 23, 2016, both of which are incorporated herein by reference in their entirety.

TECHNICAL FIELD

The present disclosure relates to the field of microwave ovens, and in particular to a method for controlling a microwave oven by voice, and a microwave oven.

BACKGROUND

Generally, a conventional microwave oven may serve but for heating. A user may adjust but how long and with what level of power a microwave oven heats an item, etc. Generally, in preparing or cooking a dish using a microwave oven, one may depend but on experience, or a recipe found online or in some other way.

To improve practicality, some microwave oven may serve to broadcast a recipe by voice. Some voice recipe may be pre-stored in a microwave oven. A user may control a microwave oven, through a panel of the microwave oven, to broadcast a recipe. A user may cook a favorite dish repeatedly. A user may have to set a level of power and a heating time of a microwave oven, etc., again and again each time the user cooks a same dish using the microwave oven. An existing microwave oven is disadvantageous in that it is incapable of smart learning of a habit in setting a parameter corresponding to a recipe. Consequently, a user may have to set a parameter for operating a microwave oven again and again each time the user cooks a same dish according to a recipe.

SUMMARY OF THE INVENTION

A main goal of the present disclosure is to provide a method for controlling a microwave oven by voice, and a microwave oven, to allow a microwave oven to smartly learn a habit in setting a parameter corresponding to a recipe so that a user does not have to set a parameter for operating the microwave oven again and again each time the user cooks a same recipe.

A method for controlling a microwave oven by voice according to the present disclosure includes:

receiving a voice instruction input by a user;

searching for a pre-stored default recipe parameter corresponding to the voice instruction;

in response to a default recipe parameter corresponding to the voice instruction being found, operating the microwave oven according to the default recipe parameter; and in response to receiving a parameter changing instruction input by the user, controlling the operation of the microwave oven according to a parameter corresponding to the parameter changing instruction, and updating, according to the parameter changing instruction, the default recipe parameter corresponding to the voice instruction.

The default recipe parameter may include a default image characterizing parameter and a default parameter for running the microwave oven. The operating the microwave oven according to the default recipe parameter may include:

acquiring an image of a dish placed inside the microwave oven;

acquiring an image characterizing parameter corresponding to the dish by recognizing the image of the dish;

in response to determining that the image characterizing parameter corresponding to the dish does not match the default image characterizing parameter, outputting a reminder; and in response to receiving a confirmation input by the user or determining that the image characterizing parameter corresponding to the dish matches the default image characterizing parameter, controlling the operation of the microwave oven according to the default parameter for running the microwave oven.

The method may further include: after the receiving a voice instruction input by a user, in response to no default recipe parameter corresponding to the voice instruction being found, acquiring a recipe tutorial corresponding to the voice instruction;

outputting a voice reminder corresponding to the recipe tutorial; receiving voice recipe parameter information, the voice recipe parameter information being input by the user based on the voice reminder; controlling an operating state of the microwave oven according to the voice recipe parameter information; and generating a default recipe parameter corresponding to the voice instruction according to the operating state of the microwave oven, and storing the default recipe parameter.

The outputting a voice reminder corresponding to the recipe tutorial; receiving voice recipe parameter information, the voice recipe parameter information being input by the user based on the voice reminder; controlling running of the microwave oven according to the voice recipe parameter information may include:

successively outputting voice reminders corresponding to stages of the recipe tutorial, by receiving, after outputting a voice reminder of a preceding stage, voice recipe parameter information, the voice recipe parameter information being input by the user based on the voice reminder of the preceding stage; controlling the operating state of the microwave oven according to the voice recipe parameter information corresponding to the preceding stage; in response to completion of the controlling the operating state of the microwave oven according to the voice recipe parameter information corresponding to the preceding stage, outputting a voice reminder of a following stage, until voice reminders of all stages have been output.

The method may further include:

in response to a voice reminder corresponding to a stage being output, determining whether a voice rebound instruction is received; and in response to the voice rebound instruction being received, outputting the voice reminder corresponding to a preceding stage once more.

The acquiring a recipe tutorial corresponding to the voice instruction may include:

sending, to a server, a recipe tutorial acquiring request corresponding to the voice instruction; and acquiring the recipe tutorial corresponding to the voice instruction returned by the server.

A microwave oven according to the present disclosure includes:

a receiving module arranged for: receiving a voice instruction input by a user;

a searching module arranged for: searching for a pre-stored default recipe parameter corresponding to the voice instruction;

a controlling module arranged for: in response to a default recipe parameter corresponding to the voice instruction being found, operating the microwave oven according to the default recipe parameter; and an updating module arranged for: in response to receiving a parameter changing instruction input by the user, controlling the operation of the microwave oven according to a parameter corresponding to the parameter changing instruction, and updating, according to the parameter changing instruction, the default recipe parameter corresponding to the voice instruction.

The default recipe parameter may include a default image characterizing parameter and a default parameter for running the microwave oven. The controlling module may include:

a first acquiring unit arranged for: acquiring an image of a dish placed inside the microwave oven;

a second acquiring unit arranged for: acquiring an image characterizing parameter corresponding to the dish by recognizing the image of the dish;

an outputting unit arranged for: in response to determining that the image characterizing parameter corresponding to the dish does not match the default image characterizing parameter, outputting a reminder; and a controlling unit arranged for: in response to receiving a confirmation input by the user or determining that the image characterizing parameter corresponding to the dish matches the default image characterizing parameter, controlling the operation of the microwave oven according to the default parameter for running the microwave oven.

The microwave oven may further include an acquiring module and a generating module. The acquiring module may be arranged for: in response to no default recipe parameter corresponding to the voice instruction being found, acquiring a recipe tutorial corresponding to the voice instruction.

The controlling module may be further arranged for: outputting a voice reminder corresponding to the recipe tutorial; receiving voice recipe parameter information, the voice recipe parameter information being input by the user based on the voice reminder; controlling an operating state of the microwave oven according to the voice recipe parameter information.

The generating module may be arranged for: generating a default recipe parameter corresponding to the voice instruction according to the operating state of the microwave oven, and storing the default recipe parameter.

The controlling module may be further arranged for: successively outputting voice reminders corresponding to stages of the recipe tutorial, by receiving, after outputting a voice reminder of a preceding stage, voice recipe parameter information, the voice recipe parameter information being input by the user based on the voice reminder of the preceding stage; controlling the operating state of the microwave oven according to the voice recipe parameter information corresponding to the preceding stage; in response to completion of the controlling the operating state of the microwave oven according to the voice recipe parameter information corresponding to the preceding stage, outputting a voice reminder of a following stage, until voice reminders of all stages have been output.

The microwave oven may further include a determining module and an outputting module.

The determining module may be arranged for: in response to a voice reminder corresponding to a stage being output, determining whether a voice rebound instruction is received.

The outputting module may be arranged for: in response to the voice rebound instruction being received, outputting the voice reminder corresponding to a preceding stage once more.

The acquiring module may be further arranged for: sending, to a server, a recipe tutorial acquiring request corresponding to the voice instruction; and acquiring the recipe tutorial corresponding to the voice instruction returned by the server.

With the method for controlling a microwave oven by voice and the microwave oven according to the present disclosure, a voice instruction input by a user is received. It is determined whether there is a pre-stored default recipe parameter corresponding to the voice instruction. When a default recipe parameter corresponding to the voice instruction is found, operation of the microwave oven is controlled according to the default recipe parameter. When a parameter changing instruction input by the user is received, the operation of the microwave oven is controlled according to a parameter corresponding to the parameter changing instruction. The default recipe parameter corresponding to the voice instruction is updated according to the parameter changing instruction. Thus, a microwave oven may keep a default recipe parameter updated according to a parameter changing instruction input by a user, and smartly learn a habit in setting a parameter corresponding to a recipe. Therefore, a default recipe parameter may be made increasingly accustomed to the user. Accordingly, the user does not have to set a parameter for operating the microwave oven again and again each time the user cooks a same recipe.

Functional characteristics, advantages, and fulfillment of goal of the present disclosure will be further described with reference to drawings and embodiments.

DETAILED DESCRIPTION

Note that embodiments herein are merely for explaining the present disclosure, and are not intended to limit the present disclosure.

Figure 1:
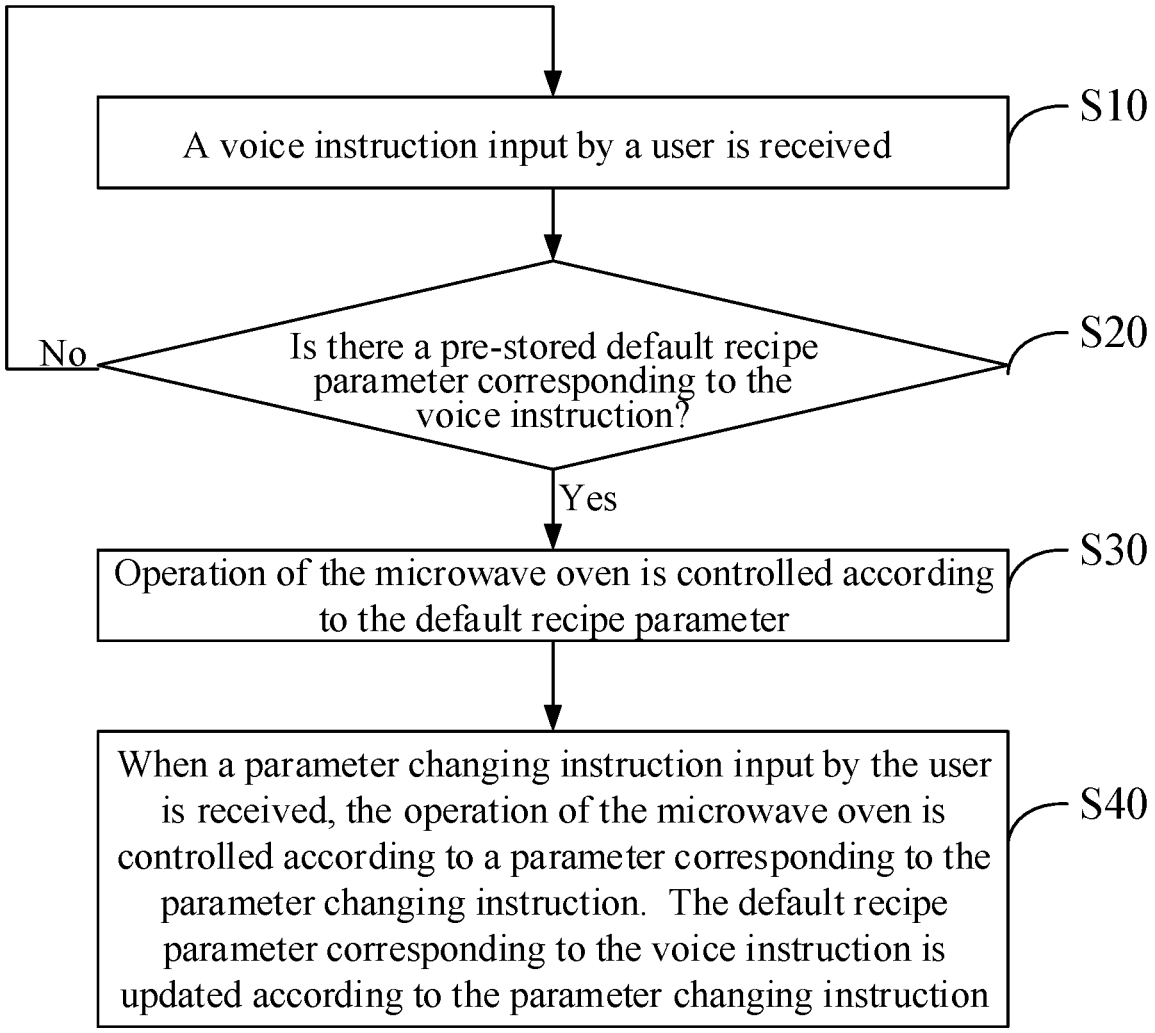
FIG. 1 is a flowchart of a first embodiment of a method for controlling a microwave oven by voice according to the present disclosure.

The present disclosure provides a method for controlling a microwave oven by voice. The method for controlling a microwave oven by voice may be implemented based on a controller of a microwave oven. Refer to FIG. 1. FIG. 1 is a flowchart of a first embodiment of a method for controlling a microwave oven by voice according to the present disclosure. The method for controlling a microwave oven by voice according to the present disclosure includes steps as follows.

In S10, a voice instruction input by a user is received.

In the present embodiment, a name of a recipe uttered by a user, such as "steamed fish", "roasted chicken wings", etc., may be received as a voice instruction. Some recipe names may be pre-stored in a microwave oven. When a sound signal is received, a voice in the sound signal may be identified. A result of the identification matching a preset recipe name may be received as the voice instruction.

Alternatively, a name of a preset ingredient uttered by a user may be received as a voice instruction. For example, a user may say "I'd like to do fish today" or "I'd like to do chicken wings today". When a sound signal is received, a microwave oven may identify "fish" or "chicken wings" by identifying a voice in the sound signal. Such an ingredient may be preset in a microwave oven. Therefore, a result of the identification matching a preset ingredient may be received as the voice instruction.

Alternatively, a microwave oven may apprehend semantics of a received sound signal. The microwave oven may determine whether a voice instruction is received according to the apprehension. For example, a user may say "I'd like to do some cooking today" or "What to cook for today?". When receiving such a sound signal, a microwave oven may learn based on semantics apprehension that the user wishes to cook. Therefore, such a sound signal may also be received as a voice instruction. In this case, the microwave oven may broadcast a recipe name pre-stored in the microwave oven. During or after the broadcast, a user may input another voice instruction. For example, a user may say "I'd like to do steamed fish".

In S20, it is determined whether there is a pre-stored default recipe parameter corresponding to the voice instruction.

In S30, when a default recipe parameter corresponding to the voice instruction is found, operation of the microwave oven is controlled according to the default recipe parameter.

It may be determined whether a default recipe parameter corresponding to the voice instruction is pre-stored locally in the microwave oven. It may be determined whether a default recipe parameter corresponding to the voice instruction is pre-stored in a cloud server. For example, first a local microwave oven may be searched for a default recipe parameter. When no default recipe parameter corresponding to the voice instruction is found locally, a cloud server may then be searched. Alternatively, first a cloud server may be searched for a default recipe parameter. When no default recipe parameter corresponding to the voice instruction is found in the cloud server, a local microwave oven may then be searched.

In the present embodiment, a default recipe parameter may be parameter information set corresponding respectively to a preset recipe. For example, a preset recipe may be steamed fish, roasted chicken wings, etc. Parameter information may be set for each preset recipe. Parameter information may include a level of power with which a microwave oven heats content, a heating time during which the heating lasts, etc. A default recipe parameter may be downloaded from Internet. A default recipe parameter may also be generated automatically by a microwave oven by smart learning of voice recipe parameter information, parameter changing information, parameter setting information, etc., that has been input by a user.

For example, a preset recipe "steamed fish" may be pre-stored in a microwave oven. After a user has said a voice instruction "I'd like to do steamed fish", the microwave oven may find the preset recipe "steamed fish". Parameter information corresponding to the preset recipe may be a heating time of 7 minutes, a level of power of "high heat", etc. Accordingly, the microwave oven will operate according to a default recipe parameter. Alternatively more specifically, a preset recipe "steamed fish, one pound, tender" may be pre-stored in a microwave oven. A user may say "I'd like to do steamed fish. The fish weighs a pound. I'd like it to be tender". Accordingly, the microwave oven may find the preset recipe "steamed fish, one pound, tender". Parameter information corresponding to the preset recipe may be a heating time of five minutes, a level of power of "medium heat", etc.

When no default recipe parameter corresponding to the voice instruction is found, the microwave oven may continue to wait to receive a voice instruction input by a user, i.e., continue with S10.

When no default recipe parameter corresponding to the voice instruction is found, the microwave oven may also output a reminder. For example, a voice "no recipe of steamed fish" may be output. In this case, a user per se may set a level of power and a heating time to control the microwave oven to perform a heating operation to cook "steamed fish".

A microwave oven may also record parameter information set by a user. The microwave oven may generate a default recipe parameter for "steamed fish" according to the parameter information set. Therefore, next time a user wishes to cook steamed fish, the microwave oven may control operation per se according to the default recipe parameter.

A default recipe parameter may also be pre-input by a user. That is, a user may preset a correspondence between a voice instruction and a default recipe parameter. For example, a correspondence between "steamed fish" and default recipe parameters of a heating time of 7 minutes and a level of power of "high heat" may be preset.

In S40, when a parameter changing instruction input by the user is received, the operation of the microwave oven is controlled according to a parameter corresponding to the parameter changing instruction. The default recipe parameter corresponding to the voice instruction is updated according to the parameter changing instruction.

A user may not be content with a default recipe parameter. For example, default recipe parameters of "steamed fish" may correspond to a heating time of 7 minutes and a level of power of "high heat". The user may prefer the dish to be tenderer this time. Therefore, a shorter heating time may be desirable. Accordingly, it is possible to adjust, before or during a heating process of the microwave oven, how long a microwave oven heats an item. For example, it is possible to change the heating time to 5 minutes. The microwave oven will then operate according to the changed parameter, i.e., heat the fish for 5 minutes. On this basis, the microwave oven will update parameter information corresponding to the default recipe parameter according to the parameter changing instruction.

The update may be done as follows. A default recipe parameter may be changed directly into a parameter corresponding to the parameter changing instruction. For example, the heating time corresponding to the default recipe parameter may be directly changed to be 5 minutes. The update may also be done as follows. A default recipe parameter may be updated according to a product of a scaling factor and a difference between the default recipe parameter and the parameter corresponding to the parameter changing instruction. For example, a heating time corresponding to a default recipe parameter and a heating time corresponding to the parameter changing instruction may differ by 2 minutes. A scaling factor may be set to be 0.5. Therefore, the product of the difference and the scaling factor may be 1 minute. Therefore, the product of 1 minute may be subtracted from the heating time of 7 minutes corresponding to the original default recipe parameter. That is, the heating time corresponding to the default recipe parameter may be updated to be 6 minutes.

With the method for controlling a microwave oven by voice according to the present disclosure, a voice instruction input by a user is received. It is determined whether there is a pre-stored default recipe parameter corresponding to the voice instruction. When a default recipe parameter corresponding to the voice instruction is found, operation of the microwave oven is controlled according to the default recipe parameter. When a parameter changing instruction input by the user is received, the operation of the microwave oven is controlled according to a parameter corresponding to the parameter changing instruction. The default recipe parameter corresponding to the voice instruction is updated according to the parameter changing instruction. Thus, a microwave oven may keep a default recipe parameter updated according to a parameter changing instruction input by a user, and smartly learn a habit in setting a parameter corresponding to a recipe. Therefore, a default recipe parameter may be made increasingly accustomed to the user. Accordingly, the user does not have to set a parameter for operating the microwave oven again and again each time the user cooks a same recipe.

Figure 2:
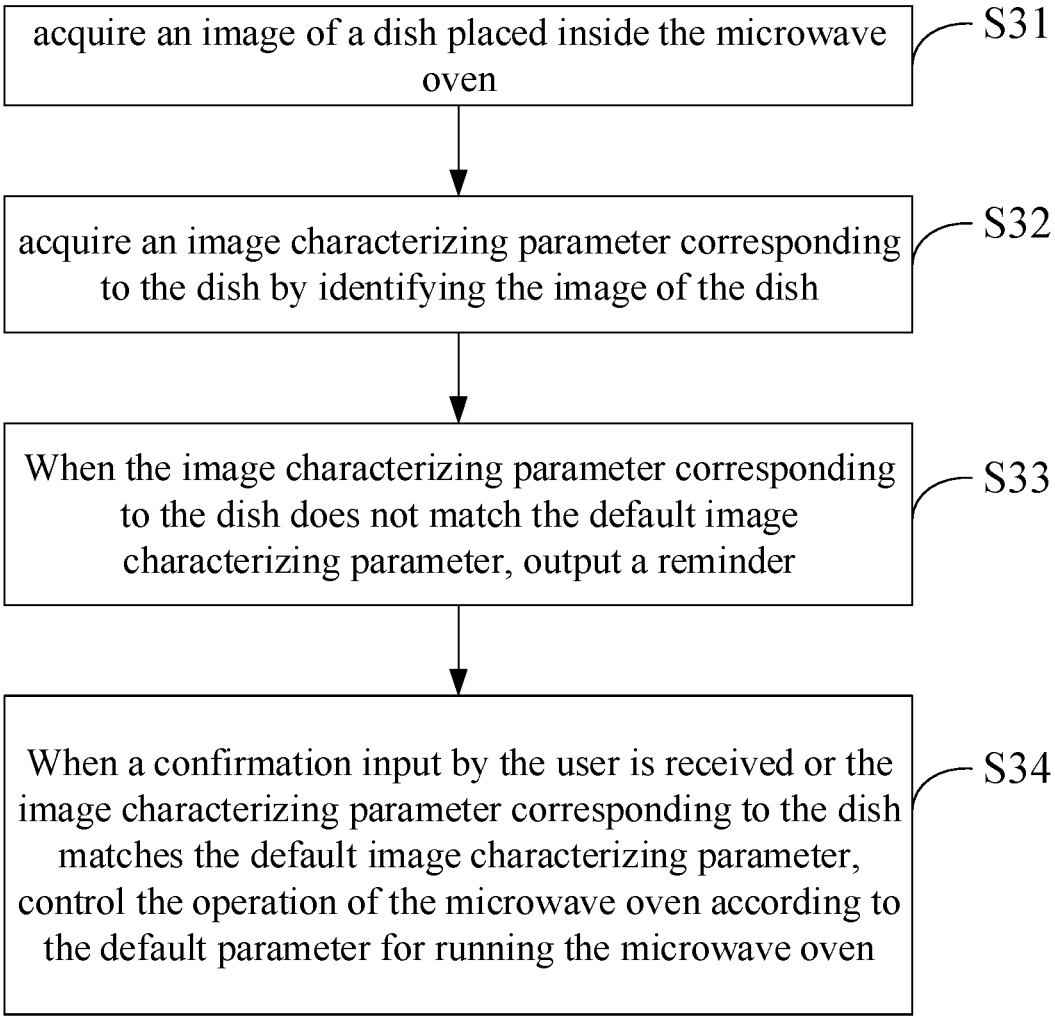
FIG. 2 is a detailed flowchart of controlling operating steps of a microwave oven in a second embodiment of a method for controlling a microwave oven by voice according to the present disclosure.

To further improve intelligence of a microwave oven to enable the microwave oven to output a reminder according to a habit of a user more smartly, thereby making a cooked dish more accustomed to taste of the user, the present disclosure further proposes a second embodiment of a method for controlling a microwave oven by voice based on the first embodiment of the method for controlling a microwave oven by voice according to the present disclosure. Refer to FIG. 2. FIG. 2 is a detailed flowchart of controlling operating steps of a microwave oven in a second embodiment of a method for controlling a microwave oven by voice according to the present disclosure. In the second embodiment, the default recipe parameter may include a default image characterizing parameter and a default parameter for running the microwave oven. The S30 may include steps as follows.

In S31, an image of a dish placed inside the microwave oven may be acquired.

In the present embodiment, a camera may be preset in a microwave oven. When a user places a dish inside the microwave oven, the microwave oven may acquire an image of the dish using the camera.

In S32, an image characterizing parameter corresponding to the dish may be acquired by recognizing the image of the dish.

In S33, when the image characterizing parameter corresponding to the dish does not match the default image characterizing parameter, a reminder may be output.

In S34, when a confirmation input by the user is received or the image characterizing parameter corresponding to the dish matches the default image characterizing parameter, the operation of the microwave oven may be controlled according to the default parameter for running the microwave oven.

A microwave oven may analyze a characteristic of the image of the dish. Taking steamed fish as an example, it is possible to determine, by recognizing the image of the dish, a number of times a surface of the fish has been cut. According to a default recipe parameter, the surface of the fish may be cut three times, for example. When it is identified that the surface of the fish has been cut but twice, a reminder, such as "Are you sure it has to be cut but twice?", may be output. The user may further input a confirmation. Or, the user may cut the fish one more time and then put the fish back in the microwave oven, such that the microwave oven may acquire another image of the dish and identify the another image, until an image characterizing parameter thereof matches the default image characterizing parameter. Alternatively, an amount of a seasoning, such as chili, soy sauce, etc., to be applied may be determined according to a color of an image of a dish by recognizing the image of the dish. A default image characterizing parameter may be an interval. It may be determined whether an image characterizing parameter corresponding to an image of a dish is located within the interval of the default image characterizing parameter. If it is located within the interval, it may be deemed that the image characterizing parameter corresponding to the dish matches the default image characterizing parameter.

Note that after the S32, if the image characterizing parameter corresponding to the dish matches the default image characterizing parameter, the operation of the microwave oven may be controlled directly according to the default parameter for running the microwave oven. When the image characterizing parameter corresponding to the dish does not match the default image characterizing parameter, a reminder may be output correspondingly. After a microwave oven has output a reminder, a user may directly input a confirmation. When the microwave oven receives the confirmation, the operation of the microwave oven may be controlled according to the default parameter for running the microwave oven. Alternatively, the user may process the dish again, such that the microwave oven may acquire another image of the dish. When a re-acquired image characterizing parameter corresponding to the dish matches the default recipe image characterizing parameter, the operation of the microwave oven may be controlled according to the default parameter for running the microwave oven.

To further improve smart learning by a microwave oven, the present disclosure further proposes a third embodiment of a method for controlling a microwave oven by voice based on the first embodiment or the second embodiment of the method for controlling a microwave oven by voice according to the present disclosure. After the S10, the method for controlling a microwave oven by voice may further include steps as follows.

When no default recipe parameter corresponding to the voice instruction is found, a recipe tutorial corresponding to the voice instruction may be acquired.

A voice reminder corresponding to the recipe tutorial may be output. Voice recipe parameter information may be received. The voice recipe parameter information may be input by the user based on the voice reminder. An operating state of the microwave oven may be controlled according to the voice recipe parameter information.

A default recipe parameter corresponding to the voice instruction may be generated according to the operating state of the microwave oven. The default recipe parameter may be stored.

A recipe tutorial may include a number of voice reminders. The voice reminders may be broadcast stage by stage. A recipe tutorial may further include a number of images or videos. The images or videos may serve as reminders of a method for cooking a dish. While such a voice reminder is being played at a stage, an image or video corresponding to the stage may also be displayed on a panel of a microwave oven.

In the present embodiment, a recipe tutorial may be acquired in two ways as follows.

In one way, a number of recipe tutorials may be preset in a microwave oven. A recipe tutorial may be stored in association with a recipe name. For example, respective recipe tutorials for "steamed fish" and for "roasted chicken wings" may be preset. When a voice instruction corresponds to a recipe name "steamed fish", a recipe tutorial for "steamed fish" may be acquired.

In the other way, a microwave oven may also download a recipe tutorial from a network according to a voice instruction. A microwave oven may be connected to a network by wire or wirelessly.

When acquiring a recipe tutorial, the recipe tutorial in a library of recipe tutorials local to a microwave oven may be acquired first. When the recipe tutorial is not found locally, the recipe tutorial may be acquired from a cloud server. A recipe tutorial corresponding to the voice instruction may be acquired as follows. A library of recipe tutorials pre-stored may be searched for the recipe tutorial corresponding to the voice instruction. A recipe tutorial acquiring request corresponding to the voice instruction may be sent to a server when there is no recipe tutorial corresponding to the voice instruction in the library of recipe tutorials, such that the server may return the recipe tutorial corresponding to the voice instruction.

In the present embodiment, there may be a library of recipe tutorials in a microwave oven. When a voice instruction is received, the library of recipe tutorials may first be searched for a recipe tutorial corresponding to the voice instruction. If a recipe tutorial corresponding to the voice instruction is found in the library of recipe tutorials, the recipe tutorial may be acquired. If no recipe tutorial corresponding to the voice instruction is found in the library of recipe tutorials, the recipe tutorial corresponding to the voice instruction may then be acquired from a network server.

When acquiring a recipe tutorial, the recipe tutorial may first be acquired from a cloud server. A recipe tutorial corresponding to the voice instruction may be acquired as follows. A recipe tutorial acquiring request corresponding to the voice instruction may be sent to a server. The recipe tutorial corresponding to the voice instruction returned by the server may be acquired. When a cloud server fails to return a recipe tutorial, the recipe tutorial in a library of recipe tutorials local to a microwave oven may be acquired. That is, a recipe tutorial corresponding to the voice instruction may be acquired further as follows. When no recipe tutorial corresponding to the voice instruction returned by the server is acquired, a library of recipe tutorials pre-stored may be searched for the recipe tutorial corresponding to the voice instruction.

The voice recipe parameter information may include dish type information, taste information, dish number information, and/or dish weight information. Dish type information may be a type of fish (such as bass, yellow croaker, etc.), a method for cooking the fish (such as by steaming, by grilling), etc., for example. Taste information may be tender, well done, etc.

In the present embodiment, a voice reminder output by a microwave oven may be in form of a question. For example, when a microwave oven acquires a recipe tutorial for "steamed fish", a voice reminder may be "What kind of fish is it?", "How much does the fish weigh in pounds?", "Would you like it to be tender or well done?", "Would you like it to be spicy or not spicy?", etc. After a user hears such a voice reminder output by the microwave oven, the user may reply accordingly. For example, the user may say "It's a bass", "One pound", "Tender, please", "Spicy", etc. What the user says may be regarded as the voice recipe parameter information. Having learned the taste, the weight, and the type of the fish, the microwave oven may determine a level of power and a heating time, etc., accordingly. That is, the operating state of the microwave oven may be controlled to include a non-heating state and a heating state. The microwave oven in a heating state may operate with a parameter such as the level of power, the heating time, etc.

The voice reminder may also be a reminder for an operation, such as "Cut each side of one-pound fish three times respectively to ensure flavor", "Cut scallion into segments, some cylindrical, some shredded", "Arrange the scallion segments and ginger slices as shown in the image", "Put shredded ginger in the belly and the head of the fish, and sprinkle some of the shredded ginger over the fish", "Cover the dish with plastic wrap, form a few holes in the wrap, and put the dish into the microwave oven", "While the fish is being steamed in the microwave oven, heat up some oil using the pot, preferably till the oil smokes", "Carefully remove the plastic wrap, lay the steamed fish flat, and cover the steamed fish with shredded scallion and parsley", "Pour the hot oil evenly over the fish, and the steamed fish is done", etc. For example, when a voice reminder of "Arrange the scallion segments and ginger slices as shown in the image" is output, a photo of arranged scallion segments and ginger slices may be displayed correspondingly, to remind a user of a way to arrange scallion segments and ginger slices. When a voice reminder at a dish preparing stage is output, a microwave oven may be in a non-heating state. When receiving a voice instruction indicating completion of dish preparation or a heating instruction, a microwave oven may control itself to perform heating according to parameters such as a heating time and a level of power determined according to voice recipe parameter information acquired. A correspondence among a recipe type, a weight, a taste, a heating time, a level of power, etc., may be pre-stored in a microwave oven.

In the present embodiment, a default recipe parameter corresponding to the voice instruction may be generated according to a parameter (such as a heating time, a level of power, etc.) during actual operation of a microwave oven, and stored.

With the embodiment, a voice instruction input by a user is received. A recipe tutorial corresponding to the voice instruction may be acquired. A voice reminder corresponding to the recipe tutorial may be output. Voice recipe parameter information may be received. The voice recipe parameter information may be input by the user based on the voice reminder. An operating state of the microwave oven may be controlled according to the voice recipe parameter information. Thus, a microwave oven may acquire basic parameter information of a dish to be cooked by a user by voice interaction with the user, such that a dish cooked using the microwave oven may serve a demand of the user better.

To further improve interaction between a microwave oven and a user to allow a dish cooked using the microwave oven to better serve a demand of the user, the present disclosure further proposes a fourth embodiment of a method for controlling a microwave oven by voice based on the third embodiment of the method for controlling a microwave oven by voice according to the present disclosure. The voice reminder corresponding to the recipe tutorial may be output, the voice recipe parameter information input by the user based on the voice reminder may be received, and the running of the microwave oven may be controlled according to the voice recipe parameter information as follows. Voice reminders of stages corresponding to the recipe tutorial may be successively output as follows. Voice recipe parameter information may be received after a voice reminder of a preceding stage has been output. The voice recipe parameter information may be input by the user based on the voice reminder of the preceding stage. The operating state of the microwave oven may be controlled according to the voice recipe parameter information corresponding to the preceding stage. After control of the operating state of the microwave oven according to the voice recipe parameter information corresponding to the preceding stage has completed, a voice reminder of a following stage may be output, until voice reminders of all stages have been output.

In the present embodiment, multiple stages may be preset in a dish tutorial. For each stage, a voice reminder may be set. Voice reminders of the stages may be played successively.

After a voice reminder of a first stage has been played, a microwave oven may wait to receive voice recipe parameter information input by a user. For example, when the microwave oven outputs the voice reminder of the first stage of "What kind of fish is it", the user may say "It's a bass". Having received such voice recipe parameter information, the microwave oven may control itself to stay in a non-heating state, and continue to play a voice reminder of a second stage. The voice reminder of the second stage may be "How much does the fish weigh in pounds?". The user may say "One pound", for example. Having received such voice recipe parameter information, the microwave oven may control itself to stay in the non-heating state, and continue to play a voice reminder of a third stage. The voice reminder of the third stage may be "Cut each side of one-pound fish three times respectively to ensure flavor".

Having played a voice reminder of a preceding stage, a microwave oven may wait for a preset time interval before playing a voice reminder of a following stage. For example, having played the voice reminder of the third stage, the microwave oven may wait for the preset time interval before playing a voice reminder of a fourth stage.

Having output the voice reminder of a preset stage, a microwave oven may wait to receive a voice confirmation input by a user. The microwave oven may output the voice reminder of the following stage upon receiving the voice confirmation. In the present embodiment, the third stage may be set as the preset stage. Having output the voice reminder of the third stage, the microwave oven may wait in the non-heating state. Meanwhile, the user may perform an operation according to the reminder of the microwave oven. For example, the user may cut both sides of the fish three times. Then, the user may say "done cutting". Having received a sound signal of "done cutting", the microwave oven may confirm, by apprehending semantics of the sound signal, that a voice confirmation is received. Therefore, the microwave oven may then output the voice reminder corresponding to the fourth stage.

The voice reminder corresponding to the fourth stage may be "Cut scallion into segments, some cylindrical, some shredded", "Put shredded ginger and shredded scallion in the belly and the head of the fish, and sprinkle some of the shredded ginger and the shredded scallion over the fish", "Place the fish erect as shown in the image to heat it more evenly", "Cover the dish with plastic wrap, form a few holes in the wrap, and put the dish into the microwave oven", etc. Having output a sentence, a microwave oven may wait for a preset time interval or receive the confirmation before outputting a next sentence.

Then, a voice reminder of a fifth stage may be output. The voice reminder of the fifth stage may be "Would you like it to be tender or well done?". A user may say "Tender, please". Having received the voice recipe parameter information corresponding to the fifth stage, a microwave oven may enter a heating state automatically. A level of power, a heating time, etc., corresponding to a heating state may be determined according to voice recipe parameter information acquired at each stage. The microwave oven may continue heating a dish accordingly, until the heating is done.

A sixth stage during a heating process or after the heating process may also be set. A voice reminder corresponding to the sixth stage may be "While the fish is being steamed in the microwave oven, heat up some oil using the pot, preferably till the oil smokes", "Pour the hot oil evenly over the fish, and the steamed fish is done", etc.

To further improve interaction between a microwave oven and a user, the present disclosure further proposes a fifth embodiment of a method for controlling a microwave oven by voice based on the fourth embodiment of the method for controlling a microwave oven by voice according to the present disclosure. The method for controlling a microwave oven by voice may further include steps as follows.

After a voice reminder corresponding to a stage has been output, it may be determined whether a voice rebound instruction is received.

When the voice rebound instruction is received, the voice reminder corresponding to a preceding stage may be output once more.

In the present embodiment, after a microwave oven has output a voice reminder at a stage, a user may wish to listen to a voice reminder of a preceding/last stage. Therefore, the user may input a rebound instruction to the microwave oven, such as by saying "Please return to the last stage", "What's the last step?", etc. The microwave oven may determine meaning of a voice signal sent by the user to determine whether a rebound instruction is received by apprehending semantics of the voice signal received.

With the method for controlling a microwave oven by voice according to the present embodiment, in case a user forgets a voice reminder corresponding to a preceding stage, the user may control a microwave oven to rebound or go back to the preceding stage, further facilitating use by the user.

To further improve interaction between a microwave oven and a user, and to allow a user to acquire a recipe with more details, to allow a dish cooked using the microwave oven to better serve a demand of the user, the present disclosure further proposes a sixth embodiment of a method for controlling a microwave oven by voice based on the fourth embodiment or the fifth embodiment of the method for controlling a microwave oven by voice according to the present disclosure. The method for controlling a microwave oven by voice may further include steps as follows.

After a voice reminder of a stage has been output, it may be determined whether a voice query is received.

When the voice query is received, the voice reminder of the stage may be output once more. Alternatively, a detailed voice reminder corresponding to the stage may be output.

In the present embodiment, after a microwave oven has output a voice reminder at a stage, a user may have missed it, or the voice reminder output by the microwave oven does not include enough details. Therefore, the user may ask the microwave oven a question, require the microwave oven to repeat the voice reminder corresponding to the stage, or require the microwave oven to elaborate the voice reminder of the stage, such as by saying "What?", "Pardon?", "Come again?", "How much to add?", etc. The microwave oven may determine meaning of a voice signal sent by the user by apprehending semantics of the voice signal received.

A detailed voice reminder may be details or elaboration of a voice reminder, or a specific step, or a specific amount to apply. For example, a microwave oven may output, at a stage, a voice reminder of "Sprinkle cumin powder, five spices powder, Chinese pepper powder, pepper powder, sugar". If a user does not know specifically how much cumin powder, five spices powder, Chinese pepper powder, pepper powder, sugar, etc., to apply, the user may ask the microwave oven a question, such as "How much to sprinkle?". When receiving the voice query, the microwave oven may output a pre-stored detailed voice reminder corresponding to the voice reminder of the stage. For example, the microwave oven may output "Sprinkle 1 gram of cumin powder", "Sprinkle 1 gram of five spices powder", "Sprinkle 1 gram of Chinese pepper powder", "Sprinkle 1 gram of pepper powder", "Sprinkle 1.5 gram of sugar", etc. Alternatively, when no detailed voice reminder corresponding to the stage is pre-stored in the microwave oven, the microwave oven may acquire a reminder corresponding to the stage from an external network. For example, the microwave oven may send, to a network server, a request to acquire the amount of "cumin powder, five spices powder, Chinese pepper powder, pepper powder, sugar" to apply corresponding to "steamed fish". A network may be searched for the amount of "cumin powder, five spices powder, Chinese pepper powder, pepper powder, sugar" to apply corresponding to existing "steamed fish". Then, information on the amount to apply (i.e., dosage information) may be returned by the network server. The dosage information may be in form of text, voice, etc. A microwave oven may broadcast text dosage information by voice, i.e., broadcast a detailed voice reminder.

With the method for controlling a microwave oven by voice according to the present embodiment, a microwave oven may output a detailed voice reminder to a user, such that the user may acquire a more detailed recipe.

The present disclosure further provides a microwave oven.

Figure 3:
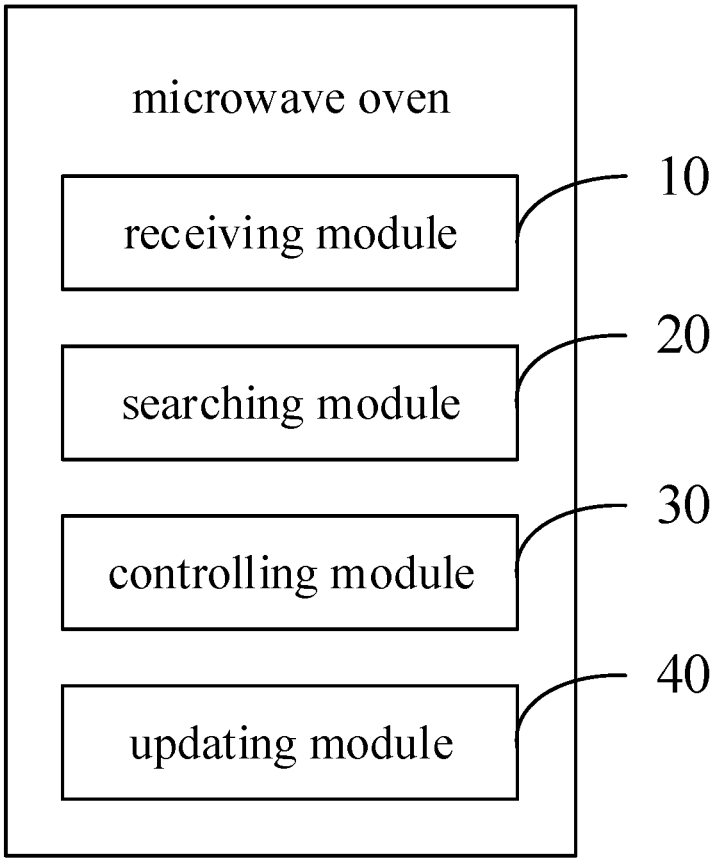
FIG. 3 is a diagram of functional modules of a first embodiment of a microwave oven according to the present disclosure.

Refer to FIG. 3. FIG. 3 is a diagram of functional modules of a first embodiment of a microwave oven according to the present disclosure. The microwave oven according to the present disclosure includes modules as follows.

A receiving module 10 is arranged for: receiving a voice instruction input by a user.

In the present embodiment, a name of a recipe uttered by a user, such as "steamed fish", "roasted chicken wings", etc., may be received as a voice instruction. Some recipe names may be pre-stored in a microwave oven. When a sound signal is received, a voice in the sound signal may be identified. A result of the identification matching a preset recipe name may be received as the voice instruction.

Alternatively, a name of a preset ingredient uttered by a user may be received as a voice instruction. For example, a user may say "I'd like to do fish today" or "I'd like to do chicken wings today". When a sound signal is received, a microwave oven may identify "fish" or "chicken wings" by identifying a voice in the sound signal. Such an ingredient may be preset in a microwave oven. Therefore, a result of the identification matching a preset ingredient may be received as the voice instruction.

Alternatively, a microwave oven may apprehend semantics of a received sound signal. The microwave oven may determine whether a voice instruction is received according to the apprehension. For example, a user may say "I'd like to do some cooking today" or "What to cook for today?". When receiving such a sound signal, a microwave oven may learn based on semantics apprehension that the user wishes to cook. Therefore, such a sound signal may also be received as a voice instruction. In this case, the microwave oven may broadcast a recipe name pre-stored in the microwave oven. During or after the broadcast, a user may input another voice instruction. For example, a user may say "I'd like to do steamed fish".

A searching module 20 is arranged for: searching for a pre-stored default recipe parameter corresponding to the voice instruction.

A controlling module 30 is arranged for: in response to a default recipe parameter corresponding to the voice instruction being found, operating the microwave oven according to the default recipe parameter.

It may be determined whether a default recipe parameter corresponding to the voice instruction is pre-stored locally in the microwave oven. It may be determined whether a default recipe parameter corresponding to the voice instruction is pre-stored in a cloud server. For example, first a local microwave oven may be searched for a default recipe parameter. When no default recipe parameter corresponding to the voice instruction is found locally, a cloud server may then be searched. Alternatively, first a cloud server may be searched for a default recipe parameter. When no default recipe parameter corresponding to the voice instruction is found in the cloud server, a local microwave oven may then be searched.

In the present embodiment, a default recipe parameter may be parameter information set corresponding respectively to a preset recipe. For example, a preset recipe may be steamed fish, roasted chicken wings, etc. Parameter information may be set for each preset recipe. Parameter information may include a level of power with which a microwave oven heats content, a heating time during which the heating lasts, etc. A default recipe parameter may be downloaded from Internet. A default recipe parameter may also be generated automatically by a microwave oven by smart learning of voice recipe parameter information, parameter changing information, parameter setting information, etc., that has been input by a user.

For example, a preset recipe "steamed fish" may be pre-stored in a microwave oven. After a user has said a voice instruction "I'd like to do steamed fish", the microwave oven may find the preset recipe "steamed fish". Parameter information corresponding to the preset recipe may be a heating time of 7 minutes, a level of power of "high heat", etc. Accordingly, the microwave oven will operate according to a default recipe parameter. Alternatively more specifically, a preset recipe "steamed fish, one pound, tender" may be pre-stored in a microwave oven. A user may say "I'd like to do steamed fish. The fish weighs a pound. I'd like it to be tender". Accordingly, the microwave oven may find the preset recipe "steamed fish, one pound, tender". Parameter information corresponding to the preset recipe may be a heating time of five minutes, a level of power of "medium heat", etc.

When no default recipe parameter corresponding to the voice instruction is found, the microwave oven may continue to wait to receive a voice instruction input by a user. That is, the receiving module 10 may continue to receive a voice instruction input by a user.

When no default recipe parameter corresponding to the voice instruction is found, the microwave oven may also output a reminder. For example, a voice "no recipe of steamed fish" may be output. In this case, a user per se may set a level of power and a heating time to control the microwave oven to perform a heating operation to cook "steamed fish".

A microwave oven may also record parameter information set by a user. The microwave oven may generate a default recipe parameter for "steamed fish" according to the parameter information set. Therefore, next time a user wishes to cook steamed fish, the microwave oven may control operation per se according to the default recipe parameter.

A default recipe parameter may also be pre-input by a user. That is, a user may preset a correspondence between a voice instruction and a default recipe parameter. For example, a correspondence between "steamed fish" and default recipe parameters of a heating time of 7 minutes and a level of power of "high heat" may be preset.

An updating module 40 is arranged for: in response to receiving a parameter changing instruction input by the user, controlling the operation of the microwave oven according to a parameter corresponding to the parameter changing instruction, and updating, according to the parameter changing instruction, the default recipe parameter corresponding to the voice instruction.

A user may not be content with a default recipe parameter. For example, default recipe parameters of "steamed fish" may correspond to a heating time of 7 minutes and a level of power of "high heat". The user may prefer the dish to be tenderer this time. Therefore, a shorter heating time may be desirable. Accordingly, it is possible to adjust, before or during a heating process of the microwave oven, how long a microwave oven heats an item. For example, it is possible to change the heating time to 5 minutes. The microwave oven will then operate according to the changed parameter, i.e., heat the fish for 5 minutes. On this basis, the microwave oven will update parameter information corresponding to the default recipe parameter according to the parameter changing instruction.

The update may be done as follows. A default recipe parameter may be changed directly into a parameter corresponding to the parameter changing instruction. For example, the heating time corresponding to the default recipe parameter may be directly changed to be 5 minutes. The update may also be done as follows. A default recipe parameter may be updated according to a product of a scaling factor and a difference between the default recipe parameter and the parameter corresponding to the parameter changing instruction. For example, a heating time corresponding to a default recipe parameter and a heating time corresponding to the parameter changing instruction may differ by 2 minutes. A scaling factor may be set to be 0.5. Therefore, the product of the difference and the scaling factor may be 1 minute. Therefore, the product of 1 minute may be subtracted from the heating time of 7 minutes corresponding to the original default recipe parameter. That is, the heating time corresponding to the default recipe parameter may be updated to be 6 minutes.

With the microwave oven according to the present disclosure, a voice instruction input by a user is received. It is determined whether there is a pre-stored default recipe parameter corresponding to the voice instruction. When a default recipe parameter corresponding to the voice instruction is found, operation of the microwave oven is controlled according to the default recipe parameter. When a parameter changing instruction input by the user is received, the operation of the microwave oven is controlled according to a parameter corresponding to the parameter changing instruction. The default recipe parameter corresponding to the voice instruction is updated according to the parameter changing instruction. Thus, a microwave oven may keep a default recipe parameter updated according to a parameter changing instruction input by a user, and smartly learn a habit in setting a parameter corresponding to a recipe. Therefore, a default recipe parameter may be made increasingly accustomed to the user. Accordingly, the user does not have to set a parameter for operating the microwave oven again and again each time the user cooks a same recipe.

Figure 4:
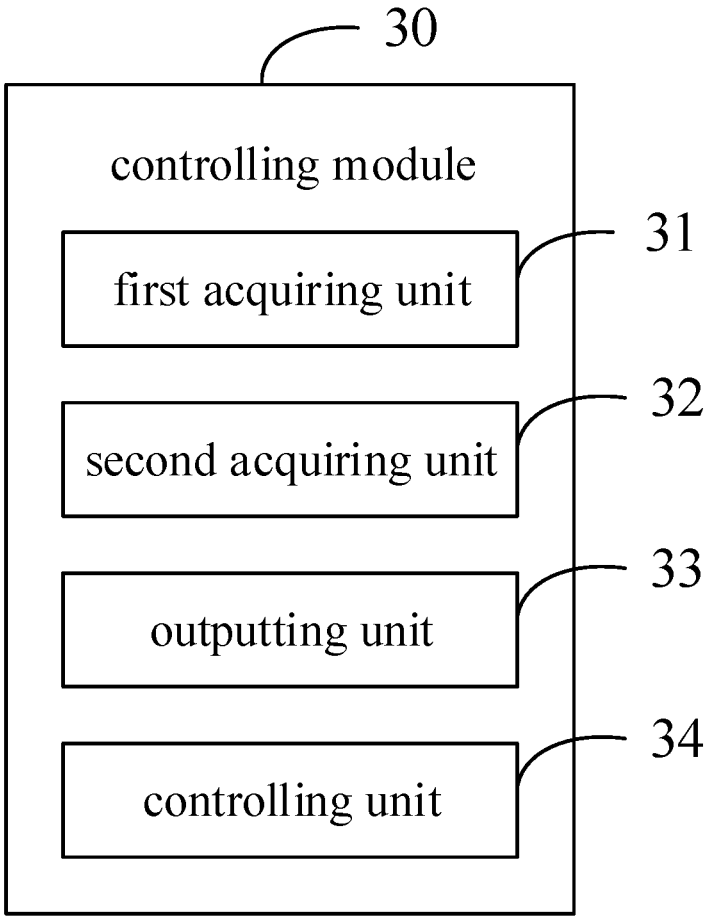
FIG. 4 is a diagram detailing a controlling module in a second embodiment of a microwave oven according to the present disclosure.

To further improve intelligence of a microwave oven to enable the microwave oven to output a reminder according to a habit of a user more smartly, thereby making a cooked dish more accustomed to taste of the user, the present disclosure further proposes a second embodiment of a microwave oven based on the first embodiment of the microwave oven according to the present disclosure. Refer to FIG. 4. FIG. 4 is a diagram detailing a controlling module in a second embodiment of a microwave oven according to the present disclosure. In the second embodiment, the default recipe parameter may include a default image characterizing parameter and a default parameter for running the microwave oven. The controlling module 30 may include units as follows.

A first acquiring unit 31 may be arranged for: acquiring an image of a dish placed inside the microwave oven.

In the present embodiment, a camera may be preset in a microwave oven. When a user places a recipe inside the microwave oven, the microwave oven may acquire an image of a dish using the camera.

A second acquiring unit 32 may be arranged for: acquiring an image characterizing parameter corresponding to the dish by recognizing the image of the dish.

An outputting unit 33 may be arranged for: in response to determining that the image characterizing parameter corresponding to the dish does not match the default image characterizing parameter, outputting a reminder.

A controlling unit 34 may be arranged for: in response to receiving a confirmation input by the user or determining that the image characterizing parameter corresponding to the dish matches the default image characterizing parameter, controlling the operation of the microwave oven according to the default parameter for running the microwave oven.

A microwave oven may analyze a characteristic of the image of the dish. Taking steamed fish as an example, it is possible to determine, by recognizing the image of the dish, a number of times a surface of the fish has been cut. According to a default recipe parameter, the surface of the fish may be cut three times, for example. When it is identified that the surface of the fish has been cut but twice, a reminder, such as "Are you sure it has to be cut but twice?", may be output. The user may further input a confirmation. Or, the user may cut the fish one more time and then put the fish back in the microwave oven, such that the microwave oven may acquire another image of the dish and identify the another image, until an image characterizing parameter thereof matches the default image characterizing parameter. Alternatively, an amount of a seasoning, such as chili, soy sauce, etc., to be applied may be determined according to a color of an image of a dish by recognizing the image of the dish. A default image characterizing parameter may be an interval. It may be determined whether an image characterizing parameter corresponding to an image of a dish is located within the interval of the default image characterizing parameter. If it is located within the interval, it may be deemed that the image characterizing parameter corresponding to the dish matches the default image characterizing parameter.

Note that if the image characterizing parameter corresponding to the dish matches the default image characterizing parameter, the operation of the microwave oven may be controlled directly according to the default parameter for running the microwave oven. When the image characterizing parameter corresponding to the dish does not match the default image characterizing parameter, a reminder may be output correspondingly. After a microwave oven has output a reminder, a user may directly input a confirmation. When the microwave oven receives the confirmation, the operation of the microwave oven may be controlled according to the default parameter for running the microwave oven. Alternatively, the user may process the dish again, such that the microwave oven may acquire another image of the dish. When a re-acquired image characterizing parameter corresponding to the dish matches the default recipe image characterizing parameter, the operation of the microwave oven may be controlled according to the default parameter for running the microwave oven.

Figure 5:
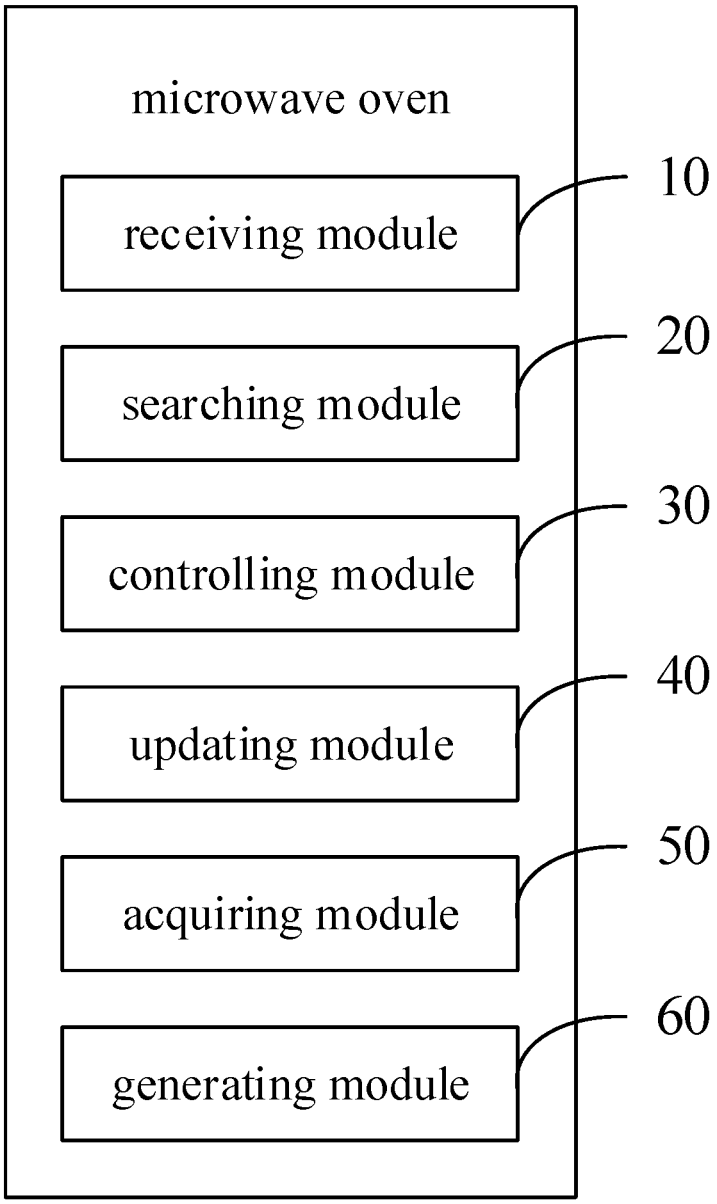
FIG. 5 is a diagram of functional modules of a third embodiment of a microwave oven according to the present disclosure.

To further improve smart learning by a microwave oven, the present disclosure further proposes a third embodiment of a microwave oven based on the first embodiment or the second embodiment of the microwave oven according to the present disclosure. Refer to FIG. 5. FIG. 5 is a diagram of functional modules of a third embodiment of a microwave oven according to the present disclosure. The microwave oven may further include an acquiring module 50 and a generating module 60. The acquiring module 50 may be arranged for: in response to no default recipe parameter corresponding to the voice instruction being found, acquiring a recipe tutorial corresponding to the voice instruction, The controlling module may be further arranged for: outputting a voice reminder corresponding to the recipe tutorial; receiving voice recipe parameter information, the voice recipe parameter information being input by the user based on the voice reminder; controlling an operating state of the microwave oven according to the voice recipe parameter information, The generating module 60 may be arranged for: generating a default recipe parameter corresponding to the voice instruction according to the operating state of the microwave oven, and storing the default recipe parameter.

A recipe tutorial may include a number of voice reminders. The voice reminders may be broadcast stage by stage. A recipe tutorial may further include a number of images or videos. The images or videos may serve as reminders of a method for cooking a dish. While such a voice reminder is being played at a stage, an image or video corresponding to the stage may also be displayed on a panel of a microwave oven.

In the present embodiment, a recipe tutorial may be acquired in two ways as follows.

In one way, a number of recipe tutorials may be preset in a microwave oven. A recipe tutorial may be stored in association with a recipe name. For example, respective recipe tutorials for "steamed fish" and for "roasted chicken wings" may be preset. When a voice instruction corresponds to a recipe name "steamed fish", a recipe tutorial for "steamed fish" may be acquired.

In the other way, a microwave oven may also download a recipe tutorial from a network according to a voice instruction. A microwave oven may be connected to a network by wire or wirelessly.

When acquiring a recipe tutorial, the acquiring module 50 may first acquire the recipe tutorial in a library of recipe tutorials local to a microwave oven. When the recipe tutorial is not found locally, the recipe tutorial may be acquired from a cloud server. A recipe tutorial corresponding to the voice instruction may be acquired as follows. In the embodiment, the acquiring module 50 may search a library of recipe tutorials pre-stored for the recipe tutorial corresponding to the voice instruction. The acquiring module may send a recipe tutorial acquiring request corresponding to the voice instruction to a server when there is no recipe tutorial corresponding to the voice instruction in the library of recipe tutorials, such that the server may return the recipe tutorial corresponding to the voice instruction.

In the present embodiment, there may be a library of recipe tutorials in a microwave oven. When a voice instruction is received, the library of recipe tutorials may first be searched for a recipe tutorial corresponding to the voice instruction. If a recipe tutorial corresponding to the voice instruction is found in the library of recipe tutorials, the recipe tutorial may be acquired. If no recipe tutorial corresponding to the voice instruction is found in the library of recipe tutorials, the recipe tutorial corresponding to the voice instruction may then be acquired from a network server.

When acquiring a recipe tutorial, the acquiring module 50 may first acquire the recipe tutorial from a cloud server. In the embodiment, the acquiring module 50 may send a recipe tutorial acquiring request corresponding to the voice instruction to a server. The acquiring module may receive the recipe tutorial corresponding to the voice instruction returned by the server. When a cloud server fails to return a recipe tutorial, the recipe tutorial in a library of recipe tutorials local to a microwave oven may be acquired. That is, when no recipe tutorial corresponding to the voice instruction returned by the server is acquired, the acquiring module 50 may search a library of recipe tutorials pre-stored for the recipe tutorial corresponding to the voice instruction.

The voice recipe parameter information may include dish type information, taste information, dish number information, and/or dish weight information. Dish type information may be a type of fish (such as bass, yellow croaker, etc.), a method for cooking the fish (such as by steaming, by grilling), etc., for example. Taste information may be tender, well done, etc.

In the present embodiment, a voice reminder output by a microwave oven may be in form of a question. For example, when a microwave oven acquires a recipe tutorial for "steamed fish", a voice reminder may be "What kind of fish is it?", "How much does the fish weigh in pounds?", "Would you like it to be tender or well done?", "Would you like it to be spicy or not spicy?", etc. After a user hears such a voice reminder output by the microwave oven, the user may reply accordingly. For example, the user may say "It's a bass", "One pound", "Tender, please", "Spicy", etc. What the user says may be regarded as the voice recipe parameter information. Having learned the taste, the weight, and the type of the fish, the microwave oven may determine a level of power and a heating time, etc., accordingly. That is, the operating state of the microwave oven may be controlled to include a non-heating state and a heating state. The microwave oven in a heating state may operate with a parameter such as the level of power, the heating time, etc.

The voice reminder may also be a reminder for an operation, such as "Cut each side of one-pound fish three times respectively to ensure flavor", "Cut scallion into segments, some cylindrical, some shredded", "Arrange the scallion segments and ginger slices as shown in the image", "Put shredded ginger in the belly and the head of the fish, and sprinkle some of the shredded ginger over the fish", "Cover the dish with plastic wrap, form a few holes in the wrap, and put the dish into the microwave oven", "While the fish is being steamed in the microwave oven, heat up some oil using the pot, preferably till the oil smokes", "Carefully remove the plastic wrap, lay the steamed fish flat, and cover the steamed fish with shredded scallion and parsley", "Pour the hot oil evenly over the fish, and the steamed fish is done", etc. For example, when a voice reminder of "Arrange the scallion segments and ginger slices as shown in the image" is output, a photo of arranged scallion segments and ginger slices may be displayed correspondingly, to remind a user of a way to arrange scallion segments and ginger slices. When a voice reminder at a dish preparing stage is output, a microwave oven may be in a non-heating state. When receiving a voice instruction indicating completion of dish preparation or a heating instruction, a microwave oven may control itself to perform heating according to parameters such as a heating time and a level of power determined according to voice recipe parameter information acquired. A correspondence among a recipe type, a weight, a taste, a heating time, a level of power, etc., may be pre-stored in a microwave oven.

In the present embodiment, the generating module 60 may generate a default recipe parameter corresponding to the voice instruction according to a parameter (such as a heating time, a level of power, etc.) during actual operation of a microwave oven, and store the default recipe parameter.

With the embodiment, a voice instruction input by a user is received. A recipe tutorial corresponding to the voice instruction may be acquired. A voice reminder corresponding to the recipe tutorial may be output. Voice recipe parameter information may be received. The voice recipe parameter information may be input by the user based on the voice reminder. An operating state of the microwave oven may be controlled according to the voice recipe parameter information. Thus, a microwave oven may acquire basic parameter information of a dish to be cooked by a user by voice interaction with the user, such that a dish cooked using the microwave oven may serve a demand of the user better.

To further improve interaction between a microwave oven and a user to allow a dish cooked using the microwave oven to better serve a demand of the user, the present disclosure further proposes a fourth embodiment of a microwave oven based on the third embodiment of the microwave oven according to the present disclosure. The controlling module 30 may be further arranged for successively outputting voice reminders corresponding to stages of the recipe tutorial, as follows. Voice recipe parameter information may be received after a voice reminder of a preceding stage has been output. The voice recipe parameter information may be input by the user based on the voice reminder of the preceding stage. The operating state of the microwave oven may be controlled according to the voice recipe parameter information corresponding to the preceding stage. After control of the operating state of the microwave oven according to the voice recipe parameter information corresponding to the preceding stage has completed, a voice reminder of a following stage may be output, until voice reminders of all stages have been output.

In the present embodiment, multiple stages may be preset in a dish tutorial. For each stage, a voice reminder may be set. Voice reminders of the stages may be played successively.

After a voice reminder of a first stage has been played, a microwave oven may wait to receive voice recipe parameter information input by a user. For example, when the microwave oven outputs the voice reminder of the first stage of "What kind of fish is it", the user may say "It's a bass". Having received such voice recipe parameter information, the microwave oven may control itself to stay in a non-heating state, and continue to play a voice reminder of a second stage. The voice reminder of the second stage may be "How much does the fish weigh in pounds?". The user may say "One pound", for example. Having received such voice recipe parameter information, the microwave oven may control itself to stay in the non-heating state, and continue to play a voice reminder of a third stage. The voice reminder of the third stage may be "Cut each side of one-pound fish three times respectively to ensure flavor".

Having played a voice reminder of a preceding stage, a microwave oven may wait for a preset time interval before playing a voice reminder of a following stage. For example, having played the voice reminder of the third stage, the microwave oven may wait for the preset time interval before playing a voice reminder of a fourth stage.

Having output the voice reminder of a preset stage, a microwave oven may wait to receive a voice confirmation input by a user. The microwave oven may output the voice reminder of the following stage upon receiving the voice confirmation. In the present embodiment, the third stage may be set as the preset stage. Having output the voice reminder of the third stage, the microwave oven may wait in the non-heating state. Meanwhile, the user may perform an operation according to the reminder of the microwave oven. For example, the user may cut both sides of the fish three times. Then, the user may say "done cutting". Having received a sound signal of "done cutting", the microwave oven may confirm, by apprehending semantics of the sound signal, that a voice confirmation is received. Therefore, the microwave oven may then output the voice reminder corresponding to the fourth stage.

The voice reminder corresponding to the fourth stage may be "Cut scallion into segments, some cylindrical, some shredded", "Put shredded ginger and shredded scallion in the belly and the head of the fish, and sprinkle some of the shredded ginger and the shredded scallion over the fish", "Place the fish erect as shown in the image to heat it more evenly", "Cover the dish with plastic wrap, form a few holes in the wrap, and put the dish into the microwave oven", etc. Having output a sentence, a microwave oven may wait for a preset time interval or receive the confirmation before outputting a next sentence.

Then, a voice reminder of a fifth stage may be output. The voice reminder of the fifth stage may be "Would you like it to be tender or well done?". A user may say "Tender, please". Having received the voice recipe parameter information corresponding to the fifth stage, a microwave oven may enter a heating state automatically. A level of power, a heating time, etc., corresponding to a heating state may be determined according to voice recipe parameter information acquired at each stage. Until heating is done.

A sixth stage during a heating process or after the heating process may also be set. A voice reminder corresponding to the sixth stage may be "While the fish is being steamed in the microwave oven, heat up some oil using the pot, preferably till the oil smokes", "Pour the hot oil evenly over the fish, and the steamed fish is done", etc.

Figure 6:
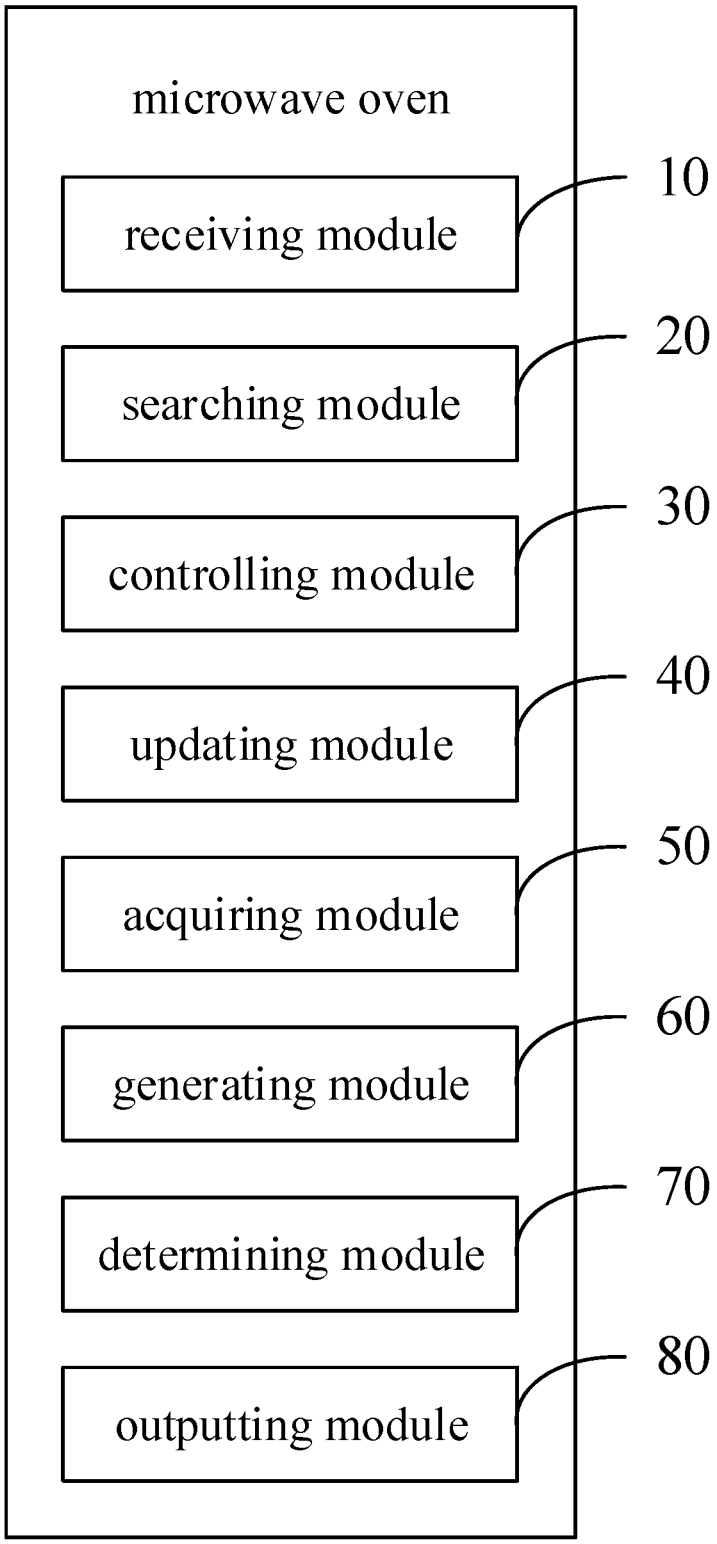
FIG. 6 is a diagram of functional modules of a fifth embodiment of a microwave oven according to the present disclosure.

To further improve interaction between a microwave oven and a user, the present disclosure further proposes a fifth embodiment of a microwave oven based on the fourth embodiment of the microwave oven according to the present disclosure. Refer to FIG. 6. FIG. 6 is a diagram of functional modules of a fifth embodiment of a microwave oven according to the present disclosure. The microwave oven may further include a determining module 70 and an outputting module 80.

The determining module 70 may be arranged for: in response to a voice reminder corresponding to a stage being output, determining whether a voice rebound instruction is received.

The outputting module 80 may be arranged for: in response to the voice rebound instruction being received, outputting the voice reminder corresponding to a preceding stage once more.

In the present embodiment, after a microwave oven has output a voice reminder at a stage, a user may wish to listen to a voice reminder of a preceding/last stage. Therefore, the user may input a rebound instruction to the microwave oven, such as by saying "Please return to the last stage", "What's the last step?", etc. The microwave oven may determine meaning of a voice signal sent by the user to determine whether a rebound instruction is received by apprehending semantics of the voice signal received.

With the method for controlling a microwave oven by voice according to the present embodiment, in case a user forgets a voice reminder corresponding to a preceding stage, the user may control a microwave oven to rebound or go back to the preceding stage, further facilitating use by the user.

To further improve interaction between a microwave oven and a user, and to allow a user to acquire a recipe with more details, to allow a dish cooked using the microwave oven to better serve a demand of the user, the present disclosure further proposes a sixth embodiment of a microwave oven based on the fourth embodiment or the fifth embodiment of the microwave oven according to the present disclosure. The microwave oven may further include a determining module and an outputting module. The determining module may be further arranged for: in response to a voice reminder of a stage being output, determining whether a voice query is received. The outputting module may be arranged for: in response to the voice query being received, outputting the voice reminder of the stage once more, or outputting a detailed voice reminder corresponding to the stage.

In the present embodiment, after a microwave oven has output a voice reminder at a stage, a user may have missed it, or the voice reminder output by the microwave oven does not include enough details. Therefore, the user may ask the microwave oven a question, require the microwave oven to repeat the voice reminder corresponding to the stage, or require the microwave oven to elaborate the voice reminder of the stage, such as by saying "What?", "Pardon?", "Come again?", "How much to add?", etc. The microwave oven may determine meaning of a voice signal sent by the user by apprehending semantics of the voice signal received.

A detailed voice reminder may be details or elaboration of a voice reminder, or a specific step, or a specific amount to apply. For example, a microwave oven may output, at a stage, a voice reminder of "Sprinkle cumin powder, five spices powder, Chinese pepper powder, pepper powder, sugar". If a user does not know specifically how much cumin powder, five spices powder, Chinese pepper powder, pepper powder, sugar, etc., to apply, the user may ask the microwave oven a question, such as "How much to sprinkle?". When receiving the voice query, the microwave oven may output a pre-stored detailed voice reminder corresponding to the voice reminder of the stage. For example, the microwave oven may output "Sprinkle 1 gram of cumin powder", "Sprinkle 1 gram of five spices powder", "Sprinkle 1 gram of Chinese pepper powder", "Sprinkle 1 gram of pepper powder", "Sprinkle 1.5 gram of sugar", etc. Alternatively, when no detailed voice reminder corresponding to the stage is pre-stored in the microwave oven, the microwave oven may acquire a reminder corresponding to the stage from an external network. For example, the microwave oven may send, to a network server, a request to acquire the amount of "cumin powder, five spices powder, Chinese pepper powder, pepper powder, sugar" to apply corresponding to "steamed fish". A network may be searched for the amount of "cumin powder, five spices powder, Chinese pepper powder, pepper powder, sugar" to apply corresponding to existing "steamed fish". Then, information on the amount to apply (i.e., dosage information) may be returned by the network server. The dosage information may be in form of text, voice, etc. A microwave oven may broadcast text dosage information by voice, i.e., broadcast a detailed voice reminder.

A microwave oven according to the present embodiment may output a detailed voice reminder to a user, such that the user may acquire a more detailed recipe.

Note that a term such as "including/comprising", "containing", or any other variant thereof is intended to cover a non-exclusive inclusion, such that a process, method, article, or device including a series of elements not only includes the elements, but also includes other element(s) not explicitly listed, or element(s) inherent to such a process, method, article, or device. Given no more limitation, an element defined by a phrase "including a . . . " does not exclude existence of another identical element in a process, method, article, or device that includes the element.

Numbering of embodiments herein is merely for illustration and does not indicate preference of one embodiment over another.

With description of the implementation herein, those skilled in the art may clearly understand that a method of an embodiment herein may be implemented by hardware, or often better, by software plus a necessary general hardware platform. Based on such an understanding, the essential part or the part contributing to prior art of a technical solution herein may be embodied in form of a software product. The computer software product may be stored in a volatile or nonvolatile memory medium, such as a Read Only Memory (ROM), a Random Access Memory (RAM), a magnetic disk, a CD, etc., that includes a number of instructions that allow terminal equipment, such as a mobile phone, a computer, a server, an air conditioner, a network device, etc., to execute the method according to an embodiment herein.

What described are merely embodiments herein, and are not intended to limit the scope of the present disclosure. Any equivalent structure or equivalent flow variation made using content of the specification and/or accompanying drawings herein, or direct or indirect application in another related technical field, likewise falls within the scope of the present disclosure.

The invention claimed is:

1. A microwave oven, comprising:

a receiving module arranged for: receiving a voice instruction input by a user;

a searching module arranged for: searching for a default recipe parameter corresponding to the voice instruction input, wherein the default recipe parameter is prestored in the microwave oven;

a controlling module arranged for: in response to the default recipe parameter corresponding to the voice instruction input being found, operating the microwave oven according to the default recipe parameter; and an updating module arranged for: in response to receiving a parameter changing instruction input by the user, controlling an operation of the microwave oven according to a parameter corresponding to the parameter changing instruction input, and updating, according to a product of a scaling factor and a difference between the default recipe parameter and the parameter corresponding to the parameter changing instruction input, the default recipe parameter corresponding to the voice instruction input, wherein the updated recipe parameter is between the default recipe parameter and the parameter corresponding to the parameter changing instruction input.

2. The microwave oven according to claim 1, wherein the default recipe parameter comprises a default image characterizing parameter and a default parameter for running the microwave oven, wherein the controlling module comprises:

a first acquiring unit arranged for: acquiring an image of a dish placed inside the microwave oven;

a second acquiring unit arranged for: acquiring an image characterizing parameter corresponding to the dish by recognizing the image of the dish;

an outputting unit arranged for: in response to determining that the image characterizing parameter corresponding to the dish does not match the default image characterizing parameter, outputting a reminder; and a controlling unit arranged for: in response to receiving a confirmation input by the user or determining that the image characterizing parameter corresponding to the dish matches the default image characterizing parameter, controlling the operation of the microwave oven according to the default parameter for running the microwave oven.

3. The microwave oven according to claim 2, further comprising:

an acquiring module and a generating module, wherein the acquiring module is arranged for: in response to no default recipe parameter corresponding to the voice instruction input being found, acquiring a recipe tutorial corresponding to the voice instruction input, wherein the controlling module is further arranged for: outputting a voice reminder corresponding to the recipe tutorial; receiving voice recipe parameter information, the voice recipe parameter information being input by the user based on the voice reminder; controlling an operating state of the microwave oven according to the voice recipe parameter information, wherein the generating module is arranged for: generating a default recipe parameter corresponding to the voice instruction input according to the operating state of the microwave oven, and storing the default recipe parameter.

4. The microwave oven according to claim 1, further comprising an acquiring module and a generating module, wherein the acquiring module is arranged for: in response to no default recipe parameter corresponding to the voice instruction input being found, acquiring a recipe tutorial corresponding to the voice instruction input, wherein the controlling module is further arranged for: outputting a voice reminder corresponding to the recipe tutorial, receiving voice recipe parameter information, the voice recipe parameter information being input by the user based on the voice reminder, and controlling an operating state of the microwave oven according to the voice recipe parameter information, wherein the generating module is arranged for: generating a default recipe parameter corresponding to the voice instruction input according to the operating state of the microwave oven, and storing the default recipe parameter.

5. The microwave oven according to claim 4, wherein the controlling module is further arranged for:

successively outputting voice reminders corresponding to stages of the recipe tutorial, by receiving, after outputting a voice reminder of a preceding stage, voice recipe parameter information, the voice recipe parameter information being input by the user based on the voice reminder of the preceding stage; controlling the operating state of the microwave oven according to the voice recipe parameter information corresponding to the preceding stage; and in response to completion of the controlling the operating state of the microwave oven according to the voice recipe parameter information corresponding to the preceding stage, outputting a voice reminder of a following stage, until the voice reminders of all stages have been output.

6. The microwave oven according to claim 5, further comprising:

a determining module and an outputting module, wherein the determining module is arranged for: in response to the voice reminder corresponding to the preceding stage being output, determining whether a voice rebound instruction is received, wherein the outputting module is arranged for: in response to the voice rebound instruction being received, outputting the voice reminder corresponding to the preceding stage once more.

7. The microwave oven according to claim 4, wherein the acquiring module is further arranged for:

sending, to a server, a recipe tutorial acquiring request corresponding to the voice instruction input; and acquiring the recipe tutorial corresponding to the voice instruction input returned by the server.

8. The microwave oven according to claim 5, further comprising:

a determining module and an outputting module, wherein the determining module is arranged for: in response to a voice reminder of a stage being output, determining whether a voice query is received, wherein the outputting module is arranged for: in response to the voice query being received, outputting the voice reminder of the stage once more, or outputting a detailed voice reminder corresponding to the stage.

* * * * *